US009712933B2

(12) United States Patent
Pontoppidan

(10) Patent No.: US 9,712,933 B2
(45) **Date of Patent: *Jul. 18, 2017**

(54) DIMINISHING TINNITUS LOUDNESS BY HEARING INSTRUMENT TREATMENT

(71) Applicant: OTICON A/S, Smørum (DK)

(72) Inventor: Niels Henrik Pontoppidan, Smørum (DK)

(73) Assignee: OTICON A/S, Smorum (DK)

( * ) Notice: Subject to any disclaimer, the term of this patent is extended or adjusted under 35 U.S.C. 154(b) by 0 days.

This patent is subject to a terminal disclaimer.

(21) Appl. No.: 15/208,340

(22) Filed: Jul. 12, 2016

(65) Prior Publication Data

US 2016/0323683 A1 Nov. 3, 2016

Related U.S. Application Data

(62) Division of application No. 14/592,673, filed on Jan. 8, 2015, now Pat. No. 9,420,389, which is a division (Continued)

(30) Foreign Application Priority Data

Jun. 6, 2011 (EP) ..... 11168755

(51) Int. Cl.
*H04R 25/00* (2006.01)

(52) U.S. Cl.
CPC ..... *H04R 25/75* (2013.01); *H04R 25/353* (2013.01); *H04R 25/505* (2013.01); *H04R 25/558* (2013.01)

(58) Field of Classification Search
CPC ..... H04R 25/75; H04R 25/505; A61B 5/128

(Continued)

(56) References Cited

U.S. PATENT DOCUMENTS 6,047,074 A 4/2000 Zoels et al.
6,104,822 A 8/2000 Melanson et al.

(Continued)

FOREIGN PATENT DOCUMENTS

CN 102075842 A 9/2009
DE 102008025485 A1 7/2009

(Continued)

OTHER PUBLICATIONS

Okamoto et al. "Listening to tailor-made notched music reduces tinnitus loudness and tinnitus-related auditory cortex activity", PNAS, vol. 107, No. 3, pp. 1207-1210 (2010).

*Primary Examiner* — Sunita Joshi
(74) *Attorney, Agent, or Firm* — Birch, Stewart, Kolasch & Birch, LLP

(57) ABSTRACT

A device for a hearing impaired person being subjected to a tinnitus is disclosed. The device includes an input transducer for providing an electric input signal comprising audio, a controllable filter for filtering the electric input signal and configured to output a filtered electric input signal such that signal energy of the electric input signal is reduced in at least a part of a frequency range, a signal processor, connected to the controllable filter, for processing the filtered electrical input signal according to a processing algorithm and to output a processed electric signal, an output transducer, connected to the signal processor, for converting the processed electric signal to an acoustic output signal to be presented to the hearing impaired person wearing the listening device, and an activator, coupled to the controllable filter, for activating and deactivating the controllable filter in dependence on a detection signal and a timer signal.

17 Claims, 2 Drawing Sheets

Related U.S. Application Data of application No. 13/489,264, filed on Jun. 5, 2012, now Pat. No. 8,976,990.

(60) Provisional application No. 61/493,528, filed on Jun. 6, 2011.

(58) Field of Classification Search
USPC ..... 381/320, 312, 317, 316, 318
See application file for complete search history.

(56) References Cited

U.S. PATENT DOCUMENTS

| | | | |
|---|---|---|---|
| 7,961,898 | B2 | 6/2011 | Van den Heuvel |
| 2002/0191804 | A1 | 12/2002 | Luo et al. |
| 2005/0251226 | A1 | 11/2005 | D'Angelo |
| 2006/0167335 | A1 | 7/2006 | Park et al. |
| 2006/0210103 | A1 | 9/2006 | Van den Heuvel |
| 2008/0123886 | A1 | 5/2008 | Andersen et al. |
| 2010/0049104 | A1 | 2/2010 | Lugli et al. |
| 2011/0046435 | A1 | 2/2011 | Jensen et al. |
| 2013/0039517 | A1 | 2/2013 | Nielsen et al. |

FOREIGN PATENT DOCUMENTS

| | | | | |
|---|---|---|---|---|
| DE | 10 2008 015 259 | A1 | 9/2009 | |
| DK | WO 2011127930 | A1 * | 10/2011 | ..... H04R 25/75 |
| WO | WO 00/56120 | | 9/2000 | |
| WO | WO 2008/087157 | A2 | 7/2008 | |
| WO | WO 2008/106975 | A2 | 9/2008 | |
| WO | WO 2008/134345 | A1 | 11/2008 | |

* cited by examiner

DIMINISHING TINNITUS LOUDNESS BY HEARING INSTRUMENT TREATMENT

CROSS-REFERENCE TO RELATED APPLICATIONS

This nonprovisional application is a Divisional of U.S. application Ser. No. 14/592,673, filed on Jan. 8, 2015, which is a Divisional of U.S. application Ser. No. 13/489,264, filed on Jun. 5, 2012, now U.S. Pat. No. 8,976,990, issued on Mar. 10, 2015, which claims priority under 35 U.S.C. §119(e) to U.S. Provisional Application No. 61/493,528, filed on Jun. 6, 2011, and under 35 U.S.C. §119(a) to Application No. EP 11168755.4, filed in Europe on Jun. 6, 2011, all of which are hereby expressly incorporated by reference into the present application.

TECHNICAL FIELD

The present invention relates to a listening device for a hearing impaired person being subjected to a tinnitus at a tinnitus frequency range. The present invention furthermore relates to a corresponding operating method of operating a listening device and to a corresponding computer program.

BACKGROUND OF THE INVENTION

A hearing impaired person using a hearing instrument for compensating his/her hearing impairment can additionally be bothered by a tinnitus. A conventional approach for treating tinnitus is to emit a sound through the hearing instrument that either compensates the tinnitus noise by means of a destructive interference or that disturbs the source of the tinnitus, such as hair cells or subsequent auditory functionality, in generating the tinnitus. Such a conventional approach is, for instance, described in U.S. Pat. No. 6,047,074. This publication suggests treating tinnitus with a programmable hearing aid that includes a signal processing chain responsible for producing a useful signal by acting on an input signal in a manner to correct a hearing impairment of a wearer of the hearing aid.

In the publication "Listening to tailor-made notched music reduces tinnitus loudness and tinnitus-related auditory cortex activity", Proceedings of the National Academy of Sciences of the United States of America (PNAS), 107 (3): 1207-1210, 2010, authors H. Okamoto et al. describe a causal treatment approach of treating a tinnitus by targeting the tinnitus percept more directly. According to the described new approach, a chronic tinnitus patient is exposed to self-chosen music, which was notched to contain no energy in the frequency range surrounding the patient's tinnitus frequency. For instance, a frequency band of one octave width centered at the individual tinnitus frequency was removed from a music energy spectrum via a digital notch filter.

SUMMARY OF THE INVENTION

It is an object of the present invention to provide a listening device offering an improved tinnitus treatment possibility. It is furthermore an object of the present invention to provide a corresponding operating method of operating a listening device and a corresponding computer program.

According to a first aspect of the present invention, the above identified technical object is achieved by a listening device for a hearing impaired person being subjected to a tinnitus at a tinnitus frequency range that comprises the following components:

- an input transducer configured to provide an electric input signal comprising audio,
- a detector coupled to the input transducer and configured to determine whether the electric input signal is a broadband signal or not and to provide a detection signal in response and
- a controllable filter for filtering the electric input signal that is coupled to the detector and the input transducer and configured to output a filtered electric input signal such that a component of the electric input signal in the tinnitus frequency range is attenuated, if the detection signal indicates that the electric input signal is a broadband signal, and to output an unfiltered electric input signal such that a component of the electric input signal in the tinnitus frequency range is not attenuated, if the detection signal indicates that the electric input signal is not a broadband signal.

The present invention includes the recognition that, on the one side, the introductorily mentioned conventional approach of treating a tinnitus by emitting a sound is, in the outcome, merely a symptom management. A conventional approach of treating a tinnitus results at best at a temporary partial elimination of the tinnitus noise, namely for the time when the signal is emitted; however, the emission of a signal does not heal the tinnitus itself. If the known hearing aid stops emitting the sound, the tinnitus will keep on bothering the hearing impaired person. On the other side, the causal treatment approach described by Okamoto et al. requires the hearing impaired person to listen to the prerecorded music over and over again in order to sustainably reduce tinnitus loudness.

In contrast, the listening device of the first aspect of the present invention automatically achieves a sustainable reduction of tinnitus loudness by detecting that the electric input signal is a broadband signal and by dampening a frequency component of the electric input signal in the tinnitus frequency range. If the listening device detects that the electric input signal is not a broadband signal, the filter will not filter the electric input signal but let it pass substantially unmodified, in particular unfiltered. Thereby, the listening device automatically promotes a reversing of maladaptive auditory cortex reorganization in the ear/ears of the hearing impaired person.

The listening device can be any hearing instrument, hearing aid, headset, earphone and in-the-ear (ITE) listening component, a completely-in-canal (CIC) listening component, a behind-the-ear (BTE) listening component, or a receiver-in-the-ear (RITE) listening component. The listening device can furthermore be an analog, a digital or an analog-digital hybrid listening device.

The term 'tinnitus frequency range' of a user is in the present context to mean a frequency range around a central tinnitus frequency $f_t$ which is perceived by a user as comprising the disturbing frequencies associated with tinnitus. The tinnitus frequency range (including the central tinnitus frequency can e.g. be determined for a given user by playing a number of narrow-band sounds (e.g. pure tones or harmonic series with missing fundamentals that span small frequency range) centered at different frequencies over the human audible frequency range (e.g. between 20 Hz and 20 kHz) and have the user identify the frequency (or frequencies) that is perceived as closest to the disturbing tinnitus sounds. In an iterative procedure, the distances in frequency between the sounds played for the user can be diminished to successively more precisely identify one or more tinnitus frequency ranges (and thus corresponding central tinnitus frequency/ies). In an embodiment, more than one distinctly different (non-overlapping) tinnitus frequency ranges of a user is defined.

In an embodiment, the component of the electric input signal in the tinnitus frequency range that is attenuated defines a 'tinnitus filtering range' (e.g. between respective minimum and maximum tinnitus filtering frequencies, e.g. corresponding to 3 dB cut-off frequencies of a band-pass filter).

The term 'a broadband signal' is in the present context taken to mean a signal having a bandwidth that is larger than the component of the electric input signal in the tinnitus frequency range that is attenuated. A broadband signal is e.g. defined as a signal that has a bandwidth larger than one third octave, e.g. larger than one octave, relative to a centre frequency $f_t$ of the tinnitus frequency range. In an embodiment, the bandwidth of the broadband signal is larger than 500 Hz, such as larger than 1 kHz, such as larger than 2 kHz. The filtering characteristic of the controllable filter is adapted to the tinnitus frequency range of the hearing impaired person that wears the listening device. This can mean that the controllable filter dampens a frequency component in the electric input signal that has a frequency identical to the frequency/frequencies of the individual tinnitus noise. However, if it is determined that a treatment of the tinnitus can be improved if other or additional components in the electric input signal that have a frequency other than the frequency of the individual tinnitus noise are dampened, the controllable filter is adjusted such that these components of the electric input signal are dampened. Thus, the filtered electric input signal can be target filtered such that a frequency band of a certain range centered at the individual tinnitus frequency is dampened from the broadband electric input signal. In another approach, the filtered electric input signal can also be a filtered signal, whose frequency components that directly surround the individual tinnitus frequency remain substantially unchanged and that other frequency components at a certain distance to the individual tinnitus frequency are dampened. However, it is preferred that the controllable filter dampens such a component of the electric input signal, whose frequency is substantially identical to the individual tinnitus frequency/frequencies. Measurement results have shown that such target filtering offers a more effective treatment of tinnitus loudness.

The controllable filter dampens the component of the electric input signal such that the amplitude of the component of the filtered electric input signal is reduced compared to the amplitude of the component of the electric input signal prior to be subjected to the filter. It is preferred that the controllable filter is configured to completely remove the component, if the detection signal indicates that the electric input signal is a broadband signal. However the advantageous effects of the controllable filter in the listening device can also be achieved, if the component is substantially reduced. For instance, the controllable filter is a notch filter, such as a digital notch filter or an analogue notch filter. Alternatively, the dampening is performed by an analysis-synthesis filter bank whose respective bands are set to zero or to another dampening value.

It shall be understood that in case that it is detected that the electric input signal is not a broadband signal and an unfiltered electric input signal is provided by the controllable filter correspondingly, such unfiltered electric input signal can be subjected to further filter means that the listening device can optionally comprise. The primary function of the controllable filter is to attenuate the relevant component of the electric input signal, if the electric input signal is a broadband signal. The controllable filter can be embedded in a filter bank of the listening device, if present, the filter bank configured to fulfill filter function that are conventional within the scope of listening devices, such as noise filtering etc. However, the controllable filter can alternatively be arranged separately in the listening device.

The wording tinnitus is to be understood to follow its standard definition in the technical field of acoustic signal processing.

In a preferred embodiment, the detector comprises a classifier for determining whether the electric input signal is a broadband signal or not. The classifier is configured to classify the electric input signal in one of a plurality of classes comprising at least: broadband music, broadband noise, such as car noise or other environmental noise, non-broadband own voice and non-broadband speech. In a preferred embodiment, the controllable filter outputs a filtered electric input signal, whose component in the tinnitus frequency range is attenuated, if the detector classifies the input signal as one or more of broadband music or broadband noise (such as car noise or other environmental noise). If, on the other hand, the electric input signal is classified as non-broadband own voice or as non-broadband speech, the controllable filter outputs a substantially unmodified electric input signal, that is to say: the controllable filter does not process the electric input signal but rather forwards it substantially unmodified to a component connected downstream of the controllable filter.

In order to perform the classification, the classifier can comprise estimation means for estimating in which class the electric input signal is to be classified. Such estimation means can perform the estimation on a regular basis known from the prior art, cf. e.g. US 2003/0144939 A1 or US2006/0179018 A1.

In a preferred embodiment, the detector is configured to provide the detection signal indicating that the input signal is a broadband signal only, if the electric input signal has not been classified as own voice or as speech. If own voice or speech is contained in the acoustic input signal, filtering the electric input signal with a controllable filter could harm the intelligibility of the signal eventually presented to the hearing impaired person wearing the listening device. Thus, if the signal is classified as voice of speech, the controllable filter does not filter the electric input signal. As the classifying can be based on estimation, the electric input signal could both be identified as being a broadband signal and as containing own voice and speech. In this case, no filtering shall take place. Level detection in hearing aids is e.g. described in WO 03/081947 A1 or U.S. Pat. No. 5,144,675. A speech detector is e.g. described in WO 91/03042 A1. Own voice detection is e.g. dealt with in US 2007/009122 A1 and in WO 2004/077090 A1.

In a particular preferred embodiment, the listening device comprises an activator coupled to the controllable filter and to the detector, which is configured to activate and deactivate the controllable filter in dependence of the detection signal. For instance, if the detection signal yields that the input signal is a broadband signal, the activator activates the filter such that the electric input signal is converted into a filtered electric input signal. If, in the other case, the detection signal yields that the electric input signal is a non-broadband signal or, respectively, that the electric input signal contains own voice or speech, the activator deactivates the controllable filter, such that the controllable filter does not process the electric input signal but rather forwards it substantially unmodified to a component of the listening device connected downstream to the controllable filter.

In another preferred embodiment, the listening device comprises a user interface configured to provide a user submitted tinnitus treatment user signal to the activator, wherein the activator is configured to activate and deactivate the controllable filter in dependence of the detection signal and the tinnitus treatment user signal. This embodiment takes into account that the hearing impaired person wearing the listening device may want to decide whether or not the controllable filter shall output a filtered electric input signal or not, as the filtered electric input signal can lead to an output signal to be presented to the hearing impaired person that differs from an output signal which has been derived from an unfiltered electric input signal. Thus, the hearing impaired person can, for instance, decide that the controllable filter only operates at certain time periods during the day.

In another preferred embodiment, the listening device additionally comprises a programmable timer configured to provide a timer signal to the activator, wherein the activator is configured to activate and deactivate the controllable filter in dependence of the detection signal and the timer signal. This embodiment can be combined with the embodiment described above that comprises a user interface. For a certain tinnitus therapy, it can be advantageous that the controllable filter is only activated at a certain times of the day and/or, respectively, for a maximum amount of time per day or, respectively, per hour or any other time unit. In an embodiment, the activator can receive the detection signal, the timer signal and a user signal and only activates the controllable filter, if all of the three aforementioned signals yield that the controllable filter should be activated, that is to say: The detection signal yields that the input signal is a broadband signal, the user signal indicates that the hearing impaired person wishes that the tinnitus therapy takes place and the timer signal allows for operation of the controllable filter. If one of the aforementioned three signals yields contrary, the controllable filter is not activated but deactivated and outputs an unfiltered electric input signal such that a component of the electric input signal in the tinnitus frequency range is not dampened.

In case the tinnitus frequency range of the user is relatively broad (or comprises a number of different (non-overlapping) frequency ranges spaced over a relatively broad frequency range), e.g. comprises more than one octave of frequencies, the listening device may be adapted to split the tinnitus therapy into a number of separate treatments (separate in time), each concentrating on a specific frequency range, each frequency range being e.g. smaller than one octave. The listening device is then adapted to provide the number of separate treatments at different points in time, e.g. in a repetitive pattern, so that that only one of the number of frequency ranges is stimulated (treated) at a given time.

It is preferred that the programmable timer is configured to determine the amount of operation time during which the controllable filter outputs the filtered electric input signal and to ensure that the operation time does not exceed a predetermined limit, wherein the predetermined limit is programmed to the timer. The predetermined limit can, for instance, analogously be formulated as "2 h per day" or "10 min per hour", "total of 100 hours maximum" and so on. Such setting of a predetermined time limit may in an embodiment be set during fitting by a Health Care Professional (HCP) of the listening device to a particular user's needs. In another embodiment, the setting of a predetermined time limit may be controlled by the user of the listening device via a user interface, e.g. a button or a remote control.

In an embodiment, the listening device is adapted to allow a user to activate a traditional tinnitus treatment (e.g. comprising playing audio pieces masking noises, delivering pleasant sounds, etc.). In the fitting process the Hearing Care Professional (HCP) may define the "treatment" schedule providing tinnitus treatment according to the present invention to a predefined period per day, e.g. 2 hours per day. If, however, the user of the listening device (e.g. via a user interface) requests the traditional tinnitus treatments with a certain frequency and/or a certain duration during daily use, the listening device may be adapted to monitor such behavior and to increase or decrease the frequency or duration of the treatments (between certain maxima and minima, e.g. set by a HCP during fitting of the device to the user in question) based on said monitored behaviour.

In another preferred embodiment, the listening device additionally comprises a memory coupled to the controllable filter and configured to store one or more individual frequency values representing the tinnitus frequency range, wherein the controllable filter is configured to adapt its filter characteristic according to the stored frequency values. Thus, after production, the listening device does not have to be a priori exactly adapted to the designated user, but can be adapted to the individual tinnitus appearance during a fitting process. Such fitting process can result in a spectral characterization of the hearing impaired person's tinnitus and in determined frequencies that shall be removed by the controllable filter. Thus, by determining the one or more individual frequency values during the fitting process, the listening device for the hearing impaired person can be adjusted to the individual tinnitus appearance.

The listening device of the first aspect of the present invention is not limited to only treat a tinnitus, but can also, in a preferred embodiment, compensate other hearing deficiencies of a hearing impaired person and generally improve intelligibility of the incoming acoustic signal.

In another preferred embodiment, the listening device comprises a signal processor connected downstream of the controllable filter and configured to process either the filtered or the unfiltered electric input signal according to a processing algorithm and to output a processed electric signal. It is further preferred that the listening device comprises an output transducer connected downstream of the signal processor and configured to convert the processed electric signal to an analog output signal to be presented to the hearing impaired person. In an embodiment, the output transducer comprises a number of electrodes of a cochlear implant or a vibrator of a bone conducting hearing device. In an embodiment, the output transducer comprises a receiver (speaker) for providing the stimulus as an acoustic signal to the user.

The input transducer is e.g. adapted to convert an acoustic input signal to an electric input signal comprising audio. The input transducer can comprise one or more microphones. The input transducer can alternatively or additionally comprise a wireless receiver for receiving an electromagnetic signal and extracting (e.g. demodulating the received signal to provide) an audio signal therefrom. The wirelessly received signal may be transmitted to the listening device from any appropriate device comprising a transmitter of an audio signal, e.g. a microphone, a telecoil, another listening device (e.g. a contralateral listening device of a binaural system), a communication device (e.g. a cellphone), an audio gateway for receiving a number of audio signals and transmitting a selected one (or a mixture of several selected signals) to the listening device (e.g. controlled by the user of the listening device), etc. The wireless transmission may be based on any communications technology of relevance to a portable listening device, e.g. near-field or far-field electromagnetic communication, light communication, etc.

According to a second aspect of the present invention, the above identified technical object is achieved by a method of operating a listening device for a hearing impaired person being subjected to a tinnitus at a tinnitus frequency range, wherein the method comprises steps of receiving an electric input signal comprising audio, determining whether the electric input signal is a broadband signal or not and providing a detection signal in response and forwarding the electric input signal to a controllable filter and outputting a filtered electric input signal such that a component of the electric input signal in the tinnitus frequency range is attenuated, if the detection signal indicates that the electric input signal is a broadband signal, or outputting an unfiltered electric input signal such that a component of the electric input signal in the tinnitus frequency range is not attenuated, if the detection signal indicates that the electric input signal is not a broadband signal.

The operating method of the second aspect of the present invention principally shares the advantages of the listening device of the first aspect of the present invention. In particular, the operating method has preferred embodiments that correspond to the additional optional features of the listening device of the first aspect of the invention described above. For instance, it is preferred that the method comprises the step of classifying the electric input signal into one of the classes: broadband sound, broadband music, broadband noise, non-broadband own speech, non-broadband voice and performing the filtering step, only if the electric input signal is a broadband signal and not a non broadband voice or speech signal. The method preferentially also comprises the step of receiving a user signal and performing the filtering step only, if the user signal yields that the hearing impaired person wishes the tinnitus treatment to be commenced. It is furthermore preferred that the method comprises a step of monitoring the time period during which a filtered electric input signal is generated and to prevent further filtering of the electric input signal, if it is determined that a predefined maximum of time has been exceeded. The received electric signal comprising audio is e.g. received from a wireless receiver (or transceiver) or from an acousto-electric transducer such as a microphone or a microphone system (e.g. comprising a number of microphones and e.g. providing as an output a directional signal).

According to a third aspect of the present invention, the above identified object is achieved by a computer program for operating a listening device, the computer program comprising program code means for causing the listening device to carry out the steps of the method of the second aspect of the present invention, when the computer program is run on a computer controlling the listening device.

The computer program of the third aspect of the invention may be stored/distributed on a suitable medium, such as an optical storage medium or a solid-state medium supplied together with or as part of other hardware, but may also be distributed in other forms, such as via the Internet or other wired or wireless telecommunication systems.

BRIEF DESCRIPTION OF THE DRAWINGS

These and other aspects will become apparent from and elucidated with reference to the embodiments described hereinafter. In the drawings.

DESCRIPTION OF EMBODIMENTS

FIG. 1 schematically shows embodiments of a listening device 100 in accordance with the first aspect of the invention. The listening device 100 is designed for a hearing impaired person being subjected to a tinnitus at a tinnitus frequency range. It shall assist in sustainably reduce loudness of a tinnitus noise bothering the hearing impaired person.

Figure 1A:
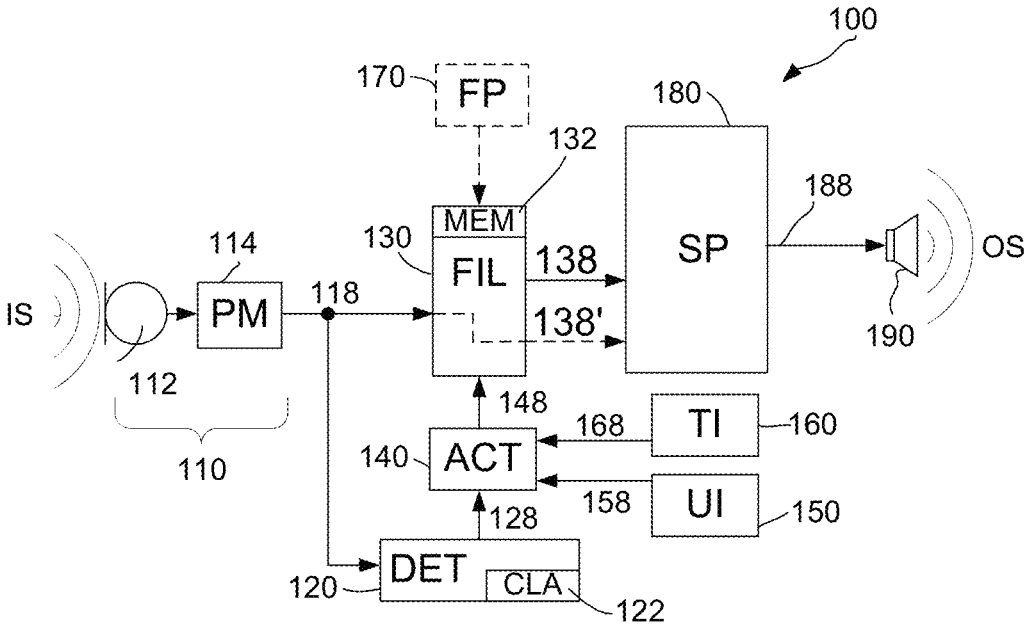
FIG. 1A and FIG. 1B show exemplary and schematically block diagrams of first and second embodiments of a listening device in accordance with the first aspect of the invention.

In the embodiment of a listening device in FIG. 1*a* the input transducer 110 comprises a microphone receiving an input sound IS and converting it to an electric input signal 118. The listening device further comprises an output transducer 190 in the form of a speaker for converting an electric signal 188 to an output sound OS.

Besides conventional components like an input transducer 110 with a microphone 112 and processing means 114 and a signal processor 180 coupled to an output transducer 190, the listening device 100 comprises a detector 120 that is coupled to the input transducer 110 and configured to determine, whether an electric input signal 118 is a broadband signal or not and to provide a corresponding detection signal 128 in response.

A controllable filter 130 of the listening device 100 is coupled to the detector 120 and to the input transducer 110 and outputs a filtered electric input signal 138 such that a component of the electric input signal 118 in the tinnitus frequency range is dampened, if the detection signal 128 yields that the electric input signal 118 is a broadband signal. In the other case, when the detection signal 128 yields that the electric input signal 118 is not a broadband signal, such as voice or speech, the controllable filter 130 does not process the electric input signal but rather forwards it substantially unmodified (signal 138') to the signal processor 180 connected downstream of the filter 130.

The activation of the controllable filter 130, that is to say: the decision, whether the controllable filter 130 is to eventually output a filtered electric input signal 138 or to output and unfiltered electric input signal 138' (basically identical to signal 118) is set by an activator 140 coupled between the filter 130 and the detector 120. The activator receives the detection signal 128 from the detector 120. Furthermore, the listening device 100 comprises a user interface 150 that allows the hearing impaired person wearing the listening device to submit a user signal 158 that indicates whether or not the wearer of the listening device 100 wants the tinnitus therapy, that is to say: the temporary filtering, to be performed. For instance, the hearing impaired person may submit the user signal through a remote control unit.

Also, the listening device 100 includes a timer 160 that provides a timer signal 168 to the activator 140, wherein the timer signal 168 indicates whether or not the controllable filter 130 is to filter the electric input signal 118. For instance, the timer 160 ensures that the wearer of the listening device 100 is exposed to an output signal deducted from the filtered electric input signal 138 only for a predetermined maximum amount of time, e.g., 2 hours per day.

The activator 140 receives the three signals 128, 158 and 168 and provides an activation signal 148 to the filter 130 in a response. Only, if all of the three signals 128, 158 and 168 yield that the controllable filter 130 is to filter the electric input signal 118, the controllable filter is activated. In all other cases, the controllable filter 138 is deactivated by a corresponding activation signal 148. For instance, if it is determined that there is speech contained in the electric signal 118, the filter 130 is deactivated. If, in another case, the user indicates that he does not wish a tinnitus therapy to be performed and submits a corresponding user signal 158, the filter 130 is also deactivated, even if it is detected that the electric input signal is a broadband signal containing no speech. Also, if the timer 160 indicates with a corresponding timer signal 168 that the maximum amount of time has been exceeded, the filter 130 is also deactivated, even, if the detection signal 128 indicates that the electric input signal 118 is a broadband signal containing no speech. It shall be understood that the listening device 100 can achieve its main technical advantages also without the timer 160 and without the user interface 150. However, both the timer 160 and the user interface 150 can lead to a more effective and to a more convenient tinnitus therapy.

The listening device 100 additionally comprises a memory 132 that is coupled to the controllable filter 130. The memory 132 stores one or more individual frequency values representing the tinnitus frequency range of the designated wearer of the listening device 100. Such one or more individual frequency values can be determined in a fitting process 170. The controllable filter 130 adapts its filter characteristic according to the stored frequency values, such that such components of the electric input signal are dampened that are supposed to be dampened in order to ensure an effective tinnitus therapy.

The detector 120 can comprise a classifier 122 that determines whether the electric input signal is a broadband signal or not by classifying the electric input signal 118 it one of a plurality of classes that comprise at least: broadband music, broadband noise, as such as cover noise or other environmental noise, non-broadband own voice and non-broadband speech. The detector 120 only outputs a detection signal 128 that heals that the controllable filter 130 is to be activated, if the electric input signal is not classified as being a non broadband own voice or a non broadband speech by the classifier 122. The classification can be performed with estimation means known from the prior art.

An acoustic input signal can thus be processed by the listening device 100 as follows: The microphone 112 of the input transducer 110 receives the acoustic input signal and converts it into an intermediate signal that is received by some processing means 114, for instance a filter bank or other processing means that are common in a hearing aid. The processing means 114 of the input transducer 110 output the electric input signal 118 that is provided to the controllable filter 130 and to the detector 120. If it is decided by the activator 140 that no tinnitus treatment is to be performed, the electric input signal 118 passes the controllable filter 130 rather unmodified and is provided as an unfiltered electric input signal 138' to the signal processor 180. The signal processor 180 can be any signal processor common in a hearing aid for processing signals such that the intelligibility of the signals is increased for the individual wearing the listening device. In particular, the signal processor can comprise further filtering means for implement, e.g., a noise filtering function. The signal processor 180 outputs a processed electric signal 188 and provides it to an output transducer 190, for it instance a loudspeaker, that converts the processed electric signal 188 to an output signal to be presented to the wearer of the listening device 100. If, in another case, the activator 140 has decided that the electric input signal 118 is to be filtered and provides a corresponding activation signal 148, the filter 130 filters the electric input signal 118 and outputs a filtered electric input signal 138 such that a component of the electric input signal 118 in the tinnitus frequency range is dampened/diminished/reduced/removed. Also, the signal processor 180 processes the filtered electric input signal 138 according to a processing algorithm, wherein the signal processor can apply different processing algorithm compared to the processing algorithm applied to the unfiltered electric input signal 138'.

The controllable filter 130 can be a notch filter or a programmable FIR or IIR filter.

Figure 1B:
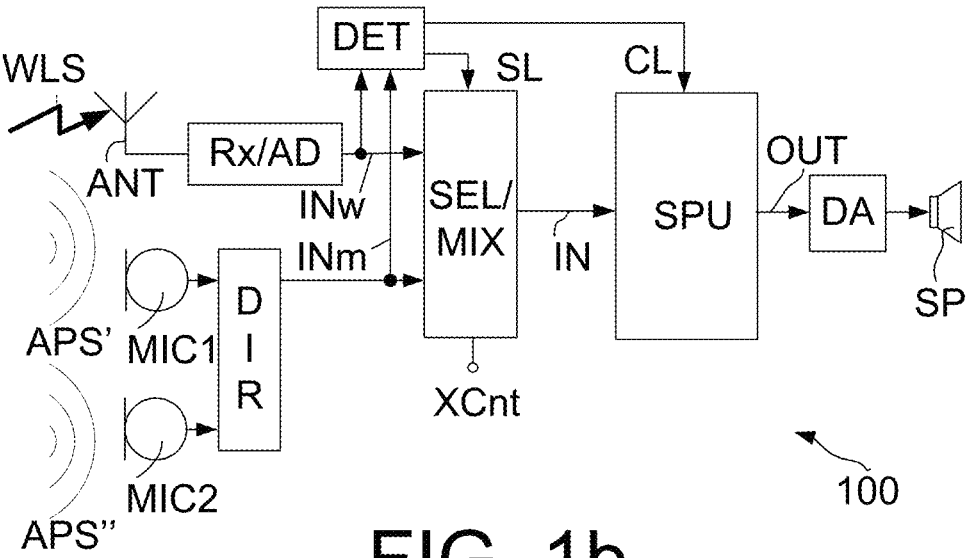

The embodiment of a listening device 100 shown in FIG. 1*b* comprises an input transducer adapted to convert an acoustic input signal to an electric input signal comprising audio in the form of a microphone system comprising two microphones MIC1, MIC2 (receiving acoustic signals APS' and APS", respectively) and a directional unit DIR for generating a weighted combination INm of the two microphone signals. The listening device 100 of FIG. 1*b* additionally comprises an input transducer comprising a wireless receiver for receiving an electromagnetic signal WLS and extracting (e.g. demodulating the received signal to provide) an audio signal INw therefrom, cf. antenna ANT and Rx/AD-unit of FIG. 1*b*. The two input signals INm and INw are connected to a selector or mixer unit SEL/MIX for selecting one of the two input signals or a weighted mixture thereof and providing the resulting input signal IN, which is fed to signal processing unit IN for further enhancement (incl. tinnitus treatment). The selector or mixer unit SEL/MIX is controlled by control signal XCnt (e.g. from a user interface) or control signal SL (e.g. automatically controlled according to the detected input signals in the detector unit DET). The two input signals INm and INw are further connected to detector unit DET for classifying one or both input signals and to decide on whether or not to activate the tinnitus treatment via control signal CL fed to the signal processing unit SPU, where the filtering (as described in connection with FIG. 1*a*) is implemented. Additionally, other signal processing may be performed in the signal processing unit, e.g. compression, noise reduction, feedback detection and cancellation, etc. The processed output OUT from the signal processing unit SPU is fed to a digital to analogue converter DA whose analogue output is fed to an output transducer, here speaker SP. Alternatively, the output transducer may comprise a number of electrodes of a cochlear implant or a vibrator of a bone conducting hearing device.

Figure 2:
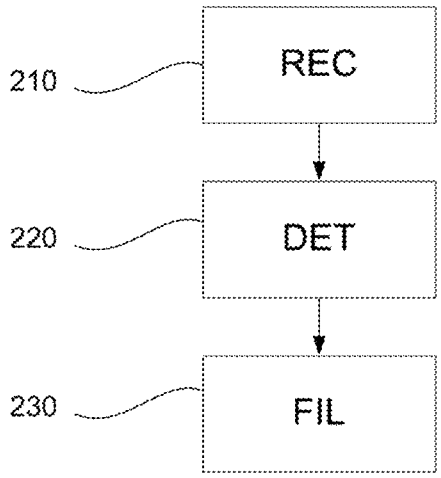
FIG. 2 shows a flow chart illustrating an operating method of operating a listening device in accordance with the second aspect of the invention.

FIG. 2 shows a flow chart illustrating an operating method 200 of operating a listening device for a hearing impaired person being subjected to a tinnitus at a tinnitus frequency range. For instance, the listening device 100 depicted in FIG. 1 can be operated according to the operating method 200.

In a first step 210, an acoustic input signal is received and converted into an electric input signal. In a second step 220, it is determined whether the electric input signal is a broadband signal or not and a detection signal is provided in response.

In a third step 230, the electric input signal is forwarded to a controllable filter and a filtered electric input signal is output such that a component of the electric input signal in the tinnitus frequency range is dampened, if the detection signal indicates that the electric input signal is a broadband signal, or an unfiltered electric input signal is output such that a component of the electric input signal in the tinnitus frequency range is not dampened, if the detection signal indicates that the electric input signal is not a broadband signal.

Figure 3:
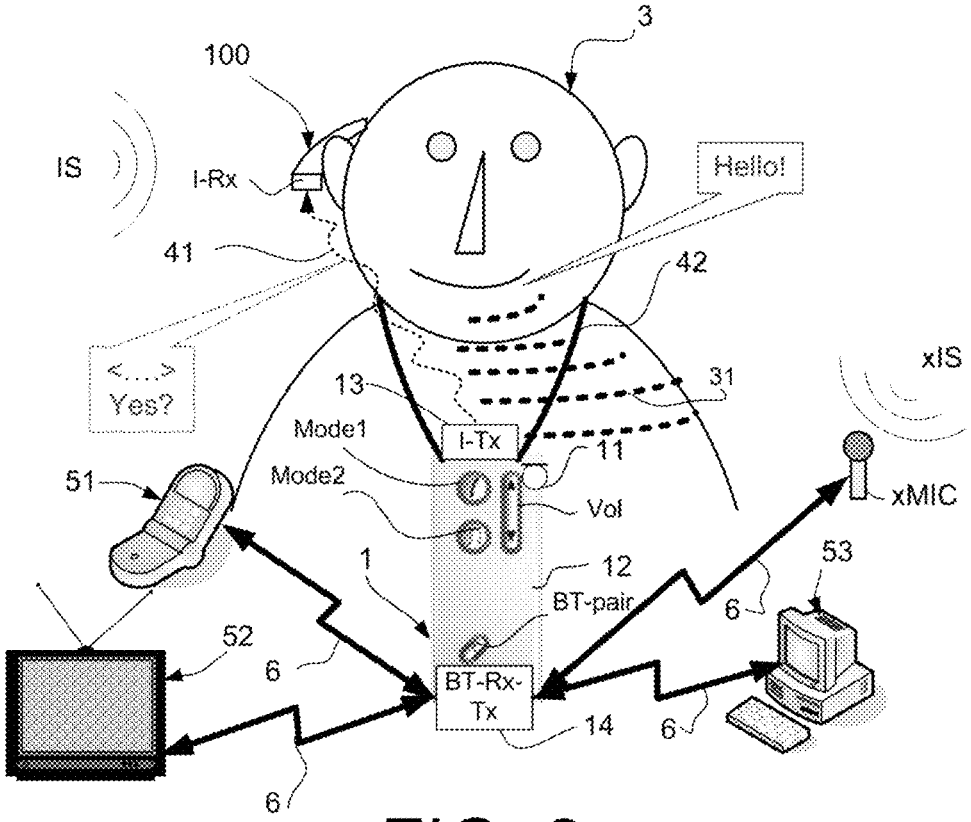
FIG. 3 shows an embodiment of a listening device applied in a system comprising the listening device and an audio gateway, the system being adapted for establishing a communication link between the two devices.

FIG. 3 shows an embodiment of a listening device 100 applied in a system comprising the listening device 100 and an audio gateway 1, the system being adapted for establishing a communication link between the two devices. The listening device of FIG. 3 is a listening device according to a first aspect of the present invention, e.g. a listening device as illustrated in FIG. 1. Preferably, the listening device 100 is a listening device comprising input transducers in the form of at least one microphone (for picking up input sound IS from the environment) as well as a wireless receiver (for receiving a wireless signal comprising audio, e.g. signal 41 from audio gateway 1), as e.g. shown in the embodiment of FIG. 1*b*. FIG. 3 shows an application scenario of an embodiment of a portable listening system comprising an audio gateway 1 and a listening device 100 according to the present invention, wherein the audio gateway device 1 comprises an audio selection device adapted for receiving a multitude of audio signals (here shown from an entertainment device, e.g. a TV 52, a telephone apparatus, e.g. a mobile telephone 51, a computer, e.g. a PC 53, and an external microphone xMIC for picking up sounds xIS from the environment, e.g. the voice of another person). In the embodiment of FIG. 3, the microphone 11 of the audio gateway device is adapted for picking up the user's own voice and capable of being connected to one or more of the external audio sources (e.g. devices 51, 53) via wireless links 6, here in the form of digital transmission links according to the Bluetooth standard as indicated by the Bluetooth transceiver 14 (BT-Tx-Rx) in the audio gateway device 1. The links may alternatively be implemented in any other convenient wireless and/or wired manner, and according to any appropriate transmission standard, possibly different for different audio sources. The microphone xMIC may e.g. be connected via an FM-link. Other audio sources than the ones shown in FIG. 3 may be connectable to the audio gateway, e.g. an audio delivery device (such as a music player or the like). The audio gateway device 1 further comprises a selector/combiner unit (not shown in FIG. 3) adapted for selecting and/or combining an appropriate signal or combination of signals for transmission to the listening device 100. The audio gateway device may further have the function of a remote control of the listening device, e.g. for changing a program or operating parameters (e.g. volume, cf. Vol-button) in the listening device. The intended mode of operation of the listening system can be selected by the user via mode selection buttons Mode1 and Mode2. Here Mode1 indicates e.g. a telephone conversation mode (where the audio signal from a currently actively paired mobile telephone is selected, e.g. device 51) and Mode2 indicates e.g. an entertainment device mode (where the audio signal from a currently actively paired entertainment device, e.g. the TV 52 or a music player, is selected). The particular selected mode determines the signals to be selected/combined in the selector/combiner unit for transmission to the listening device. A further tinnitus treatment mode may be selected or deselected via the user interface on the audio gateway device 1 (e.g. via an extra dedicated button or e.g. via an existing button, e.g. the Mode2 button, e.g. via a predefined push pattern, e.g. an extra long press of the button).

The listening device 100 is shown as a device mounted at the ear of a user 3, e.g. a hearing aid. The listening device 100 of the embodiment of FIG. 3 comprises a wireless transceiver, here indicated to be based on inductive communication (I-Rx). The transceiver (at least) comprises an inductive receiver (i.e. an inductive coil, which is inductively coupled to a corresponding coil in a transceiver (I-Tx) of the audio gateway device 1), which is adapted to receive the audio signal from the audio gateway device (either as a baseband signal or as a modulated (analogue or digital) signal, and in the latter case to extract the audio signal from the modulated signal). The inductive link 41 between the audio gateway device and the listening device is indicated to be one-way, but may alternatively be two-way (e.g. to be able to exchange control signals between transmitting 1 and receiving 100 device, e.g. to agree on an appropriate transmission channel). Alternatively or additionally, the listening device (and/or the audio gateway device) may be adapted to receive an audio signal from a telecoil.

An audio selection device, which may be modified and used according to the present invention is e.g. described in EP 1 460 769 A1, EP 1 981 253 A1 and in WO 2009/135872 A1.

The invention claimed is:

1. A listening device for a hearing impaired person being subjected to a tinnitus, the listening device comprising an input transducer configured to provide an electric input signal comprising audio;

a controllable filter for filtering the electric input signal received from the input transducer, the controllable filter being configured to output a filtered electric input signal such that signal energy of the electric input signal is reduced in at least a part of a frequency range of the electric input signal;

a signal processor connected downstream of the controllable filter and configured to process the filtered electrical input signal according to a processing algorithm and to output a processed electric signal;

an output transducer connected downstream of the signal processor and configured to convert the processed electric signal to an acoustic output signal to be presented to the hearing impaired person wearing the listening device; and a programmable timer configured to provide a timer signal to an activator, wherein the activator is coupled to the controllable filter and configured to activate and deactivate the controllable filter in dependence on a detection signal and the timer signal.

2. The listening device according to claim 1, further comprising a detector coupled to the input transducer and configured to determine whether the electric input signal is a broadband signal or not and to provide the detection signal to the activator.

3. The listening device according to claim 1, further comprising a user interface configured to provide a user submitted tinnitus treatment user signal to the activator, the activator being configured to activate and deactivate the controllable filter in dependence of the detection signal and the tinnitus treatment user signal.

4. The listening device according to claim 1, wherein the activator is configured to receive the detection signal, the user signal and the timer signal; and activates the controllable filter if the detection signal, the user signal and the timer signal yield activation of the controllable filter.

5. The listening device according to claim 1, wherein the programmable timer is configured to determine the amount of operation time during which the controllable filter outputs the filtered electric input signal and to prevent the operation time to exceed a predetermined limit.

6. The listening device according to claim 1, wherein reducing the signal energy of the electric input signal in at least a part of a frequency range comprises reducing signal energy of the electric input signal in the tinnitus frequency range comprising a tinnitus frequency.

7. The listening device according to claim 1, wherein reducing the signal energy of the electric input signal in at least a part of the frequency range comprises reducing signal energy of the electric input signal at a distance to the tinnitus frequency comprising a tinnitus frequency.

8. The listening device according claim 1, wherein the controllable filter is configured to receive the detection signal from the detector;

not to filter the electric input signal if the detection signal indicates that the electric input signal is classified as own voice or speech; and to forward an unfiltered or substantially unfiltered electric input signal downstream from the controllable filter to the signal processor.

9. The listening device according to claim 1, wherein the listening device is selected from a hearing aid, headset or earphone.

10. A listening device for a hearing impaired person being subjected to a tinnitus, the listening device comprising an input transducer configured to provide an electric input signal comprising audio;

a controllable filter for filtering the electric input signal received from the input transducer, the controllable filter being configured to output a filtered electric input signal such that signal energy of the electric input signal is reduced in at least a part of a frequency range of the electric input signal;

a signal processor connected downstream of the controllable filter and configured to process the filtered electrical input signal according to a processing algorithm and to output a processed electric signal;

an output transducer connected downstream of the signal processor and configured to convert the processed electric signal to an acoustic output signal to be presented to the hearing impaired person wearing the listening device; and a programmable timer configured to determine an amount of operation time during which the controllable filter outputs the filtered electric input signal and is configured to prevent the operation time exceeding a predetermined limit.

11. The listening device according to claim 10, further comprising a detector coupled to the input transducer configured to determine whether the electric input signal is a broadband signal or not and to provide the detection signal to an activator.

12. The listening device according to claim 10, wherein the programmable timer is configured to provide a timer signal to an activator, wherein the activator is configured to activate and deactivate the controllable filter in dependence of the detection signal and the timer signal.

13. The listening device according to claim 10, further comprising a user interface configured to provide a user submitted tinnitus treatment user signal to the activator, the activator being configured to activate and deactivate the controllable filter in dependence of the detection signal and the tinnitus treatment user signal.

14. The listening device according to claim 10, wherein the activator is configured to receive a detection signal, the user signal and the timer signal; and activates the controllable filter if the detection signal, the user signal and the timer signal yield activation of the controllable filter.

15. The listening device according to claim 10, wherein reducing the signal energy of the electric input signal in at least a part of a frequency range comprises reducing signal energy of the electric input signal in the tinnitus frequency range comprising a tinnitus frequency.

16. The listening device according to claim 10, wherein reducing the signal energy of the electric input signal in at least a part of the frequency range comprises reducing signal energy of the electric input signal at a distance to the tinnitus frequency comprising a tinnitus frequency.

17. The listening device according to claim 10, wherein the listening device is selected from a hearing aid, headset or earphone.

* * * * *